US007798063B2

(12) United States Patent
Andresen et al.

(10) Patent No.: US 7,798,063 B2
(45) Date of Patent: Sep. 21, 2010

(54) REDUCING BACK-REFLECTION DURING ABLATIVE IMAGING

(75) Inventors: Jürgen Andresen, Oldendorf (DE); Wolfgang Sievers, Kremperheide (DE)

(73) Assignee: Esko-Graphics Imaging GmbH, Itzehoe (DE)

( * ) Notice: Subject to any disclaimer, the term of this patent is extended or adjusted under 35 U.S.C. 154(b) by 376 days.

(21) Appl. No.: 11/559,068

(22) Filed: Nov. 13, 2006

(65) Prior Publication Data

US 2008/0110357 A1 May 15, 2008

(51) Int. Cl.

| | |
|---|---|
| ***B41C 3/08*** | (2006.01) |
| ***B41N 6/00*** | (2006.01) |
| ***G21C 11/00*** | (2006.01) |
| ***G21F 1/00*** | (2006.01) |
| ***G21F 3/00*** | (2006.01) |
| ***G21F 7/00*** | (2006.01) |

(52) U.S. Cl. ..... 101/401.1; 250/515.1

(58) Field of Classification Search ..... 101/401.1; 250/515.1, 519.1

See application file for complete search history.

(56) References Cited

U.S. PATENT DOCUMENTS

| | | | | | |
|---|---|---|---|---|---|
| 3,865,589 | A | * | 2/1975 | Freeman et al. | 430/271.1 |
| 3,931,030 | A | | 1/1976 | Ohno | 252/79.4 |
| 4,042,466 | A | | 8/1977 | Anselrode | 204/11 |
| 4,309,455 | A | | 1/1982 | Miyagawa | 205/114 |
| 4,423,135 | A | * | 12/1983 | Chen et al. | 430/271.1 |
| 4,980,564 | A | * | 12/1990 | Steelmon | 250/505.1 |
| 5,212,387 | A | * | 5/1993 | Swan | 250/515.1 |
| 5,309,925 | A | * | 5/1994 | Policastro | 128/849 |
| 5,338,627 | A | | 8/1994 | Shigeta | 430/6 |
| 5,378,509 | A | | 1/1995 | Achreiner | 427/556 |
| 5,403,701 | A | * | 4/1995 | Lum et al. | 430/315 |
| 5,654,833 | A | * | 8/1997 | Fujike et al. | 359/822 |
| 6,090,529 | A | | 7/2000 | Gelbart | 430/306 |
| 6,321,651 | B1 | * | 11/2001 | Tice et al. | 101/248 |
| 6,521,391 | B1 | * | 2/2003 | Bennett et al. | 430/275.1 |
| 6,631,676 | B2 | * | 10/2003 | Weichmann et al. | 101/170 |

(Continued)

FOREIGN PATENT DOCUMENTS

| | | |
|---|---|---|
| GB | 1 567 698 | 5/1980 |

(Continued)

OTHER PUBLICATIONS

"Fashionable Fabrics: Helping Design Materials For A More Beautiful World," Nickel Magazine, vol. 21, No. 3, May 2006, pp. 6-7. Downloaded on Oct. 12, 2006 at http://www.nickelmagazine.org/index.cfm/ci_id/14962.htm.

(Continued)

*Primary Examiner*—Judy Nguyen
*Assistant Examiner*—Leo T Hinze
(74) *Attorney, Agent, or Firm*—Dov Rosenfeld; Inventek

(57) ABSTRACT

A method includes exposing a plate on a support surface of an imager using one or more laser beams, the exposing while there is a metallic screen structure located on the support surface between the plate and the support surface such that the amount of back-reflected radiation is reduced compared to the plate being placed directly on the support structure with no screen between the plate and support surface. An apparatus includes the combination of a base material having the support surface and the metallic screen structure thereon.

26 Claims, 6 Drawing Sheets

U.S. PATENT DOCUMENTS

| | | | | |
|---|---|---|---|---|
| 6,631,679 | B2 * | 10/2003 | Bennett et al. | 101/457 |
| 7,067,232 | B2 | 6/2006 | Bennett et al. | 430/276.1 |
| 2002/0119399 | A1 | 8/2002 | Leskanic | 430/320 |
| 2003/0129530 | A1 | 7/2003 | Leinenbach et al. | 430/270.1 |
| 2004/0216627 | A1 | 11/2004 | Koifman et al. | 101/150 |
| 2005/0139106 | A1 * | 6/2005 | Muraoka et al. | 101/401.1 |

FOREIGN PATENT DOCUMENTS

| | | |
|---|---|---|
| GB | 2 223 984 | 4/1990 |
| JP | 01105233 | 4/1989 |
| WO | WO 00/56554 | 9/2000 |

OTHER PUBLICATIONS

"TEC-Print Galvano Screen Engraving," ROTHTEC Engraving Corporation, New Bedford, MA. Downloaded Oct. 12, 2006 from http://www.rothtec.com/english/printing/galvano_screen_engraving.asp.

"TEC-Print Rotary Screen Engraving," ROTHTEC Engraving Corporation, New Bedford, MA. Downloaded Oct. 12, 2006 from http://www.rothtec.com/english/printing/rotary_screen_engraving.asp.

"Rotary Printing & Technical Screens," SAUERESSIG GmbH & Co., Vreden, Germany. Downloaded Oct. 12, 2006 at http://www.saueressig.de/portal/pdf/prospekte/TE_Textil_01_04_E.pdf.

Wim Zoomer, "Get Production Rolling With Rotary Screen Printing," ScreenWeb, Cincinnati, OH, Dec. 16, 2002. Downloaded Oct. 12, 2006 at : http://www.screenweb.com/index.php/channel/4/id/689.

"Rotary Screens for Textile Printing, Engraving Chemicals, Endrings," Stork Prints B.V., Boxmeer, The Netherlands. Downloaded Oct. 12, 2006 at: http://www.storkprints.com/Downloads/Prints/Prints/Textile%20printing/Delivery%20program%20nw2%205.pdf.

"Expand Your Possibilities in Wallcovering and Textile Printing," Stork Prints B.V., Boxmeer, The Netherlands. Downloaded Oct. 12, 2006 at: http://stork.com/prints/Downloads/Prints/Prints/Textile%20printing/SpecialScreens.pdf.

"Galvano Screens," Saxon Screens, Frankenberg, Germany. Downloaded Feb. 9, 2007 at: http://www.saxon-screens.de/galvano.html.

Extended European Search Report for EP Application 07075974.1.

* cited by examiner

REDUCING BACK-REFLECTION DURING ABLATIVE IMAGING

BACKGROUND

The present invention relates to imagers that use one or more laser beams to expose material, e.g., for computer-to-plate (CTP) imaging to expose a printing plate.

Back-reflection is a known problem with laser-based computer-to-plate imagers exposing a film or photopolymer plate. Note that imagers for imaging plates are also commonly called imagesetters.

Many state of the art imagers are designed to process a wide variety of different plate types, not only from different vendors but also used for very different technical purposes. For example, Cyrel™ digital imagers made by Esko-Graphics NV of Gent Belgium, may be used for imaging film, imaging conventional polymer flexographic plates, and also imaging metal-backed polymer plates. Any one of these materials is referred to as a plate herein. Different types of plates typically might use different mechanisms to hold a plate onto the drum. Metal-backed plates for example, are preferably held onto the drum by permanent magnets embedded into the drum surface. Film plate and conventional computer-to-plate (CTP) polymer plates are preferably held onto the drum surface by vacuum, e.g., by vacuum applied from the inside of the drum to vacuum grooves and/or holes on the drum surface.

In many ablative plate and film imagers, problems arise from laser light not being absorbed by the layer of laser-light-sensitive ablatable material, called the "ablatable-layer" herein. This unabsorbed light can be reflected by the drum surface back to the rear side of the plate or film. This can cause several problems. A first problem is that back-reflected light can start undesired ablation or uncontrolled vaporization of the remaining ablatable-layer on the front side of the plate or film. A second problem is that the grooves and/or magnets on the surface of the drum, that is, variations in the surface property of the drum will affect the amount of back-reflected light either because of the variations in the drum surface absorption or because of variations relative amounts of reflected light and scattered light.

As an example of the second problem, suppose, for example, that image data is used that in a properly exposed plate would generate an image having a constant screen ruling. Suppose further that the grooves and/or magnets on the surface of the drum are regular structures. These structures cause changes of the back-reflected light, and as a result, instead of the image having a constant screen ruling, there may be, in addition, images that are similar to the regular variations on the drum surface caused by the grooves and/or magnets.

One common workaround is to use a laser whose laser radiation has high divergence. One example of such a laser is a multi mode laser diode. In such a case, the light from the laser will diverge so strongly that the back-reflected beam is not likely to have sufficient energy density to cause any ablation or other effect on the ablatable layer of the plate. This approach however has the disadvantage that the depth of focus for such a laser beam is very small. Consequently, the distance between any focusing optics used to focus the beam, and the plate surface has to be accurately maintained at a constant level, either by use of high mechanical accuracy or by an automatic focusing systems. In either case, the solution is relatively expensive.

Another solution is to use a use a drum whose surface is made from a material that absorbs radiation well. Unfortunately, most good absorbing materials such as black paint or anodized aluminium, might be, and likely will be ablated or discolored if exposed to a laser beam, so in time, the radiation absorbing property will be significantly reduced.

SUMMARY

It is a general object of the present invention to overcome or ameliorate at least one disadvantage of the prior art, or to provide a useful alternative.

One particular embodiment includes a method comprising exposing a plate on a support surface of an imager using one or more laser beams, the exposing while there is a metallic screen structure located on the support surface between the plate and the support surface such that the amount of back-reflected radiation is reduced compared to the plate being placed directly on the support structure with no screen between the plate and support surface.

One embodiment includes an apparatus comprising: a base structure including a support surface of an imager that uses one or more laser beams to expose a plate, the support surface configured to support a plate thereon; and a metallic screen structure located on the support surface between the plate and the support surface such that the amount of back-reflected radiation is reduced during imaging of the plate using the imager compared to the plate being placed directly on the support structure with no screen between the plate and support surface.

In one embodiment, the screen structure is made of a metallic material that is relatively resistant to laser radiation in the range energy densities that would occur at the rear side of a plate during the imaging if no metallic screen structure was located on the support surface.

In one embodiment, the imager is a drum imager including a drum, and wherein the support surface is the surface of the drum.

In one embodiment, the imager is a flatbed imager and the support surface is the relatively flat surface of the flatbed imager.

In one embodiment, the plate is metal-backed plate, and the support surface has one or more magnetic structured configured to help keep the metal-back plate on the surface, and wherein the metallic screen structure includes a magnetizable material such that the plate is maintainable on the combination of the support surface and the metallic screen structure thereon.

In one embodiment, the support surface has one or more vacuum grooves and/or holes to which a vacuum is applicable, and the screen structure has sufficient relative permeability to air, such that when a vacuum is applied to the vacuum grooves and/or holes, the plate is maintainable on the combination of the support surface and the metallic screen structure thereon.

DETAILED DESCRIPTION

Described herein is a method and an apparatus that is operative to ensure a relatively low level of back-reflected laser radiation during exposure of a plate in a computer-to-plate imager that uses one or more laser beams for the exposure. Embodiments of the invention are applicable to both drum imagers and flatbed imagers. The description, however, is mostly of an embodiment for use in an external drum imager. How to modify for a flatbed imager would be clear and straightforward to one of ordinary skill in the art.

Figure 1A:
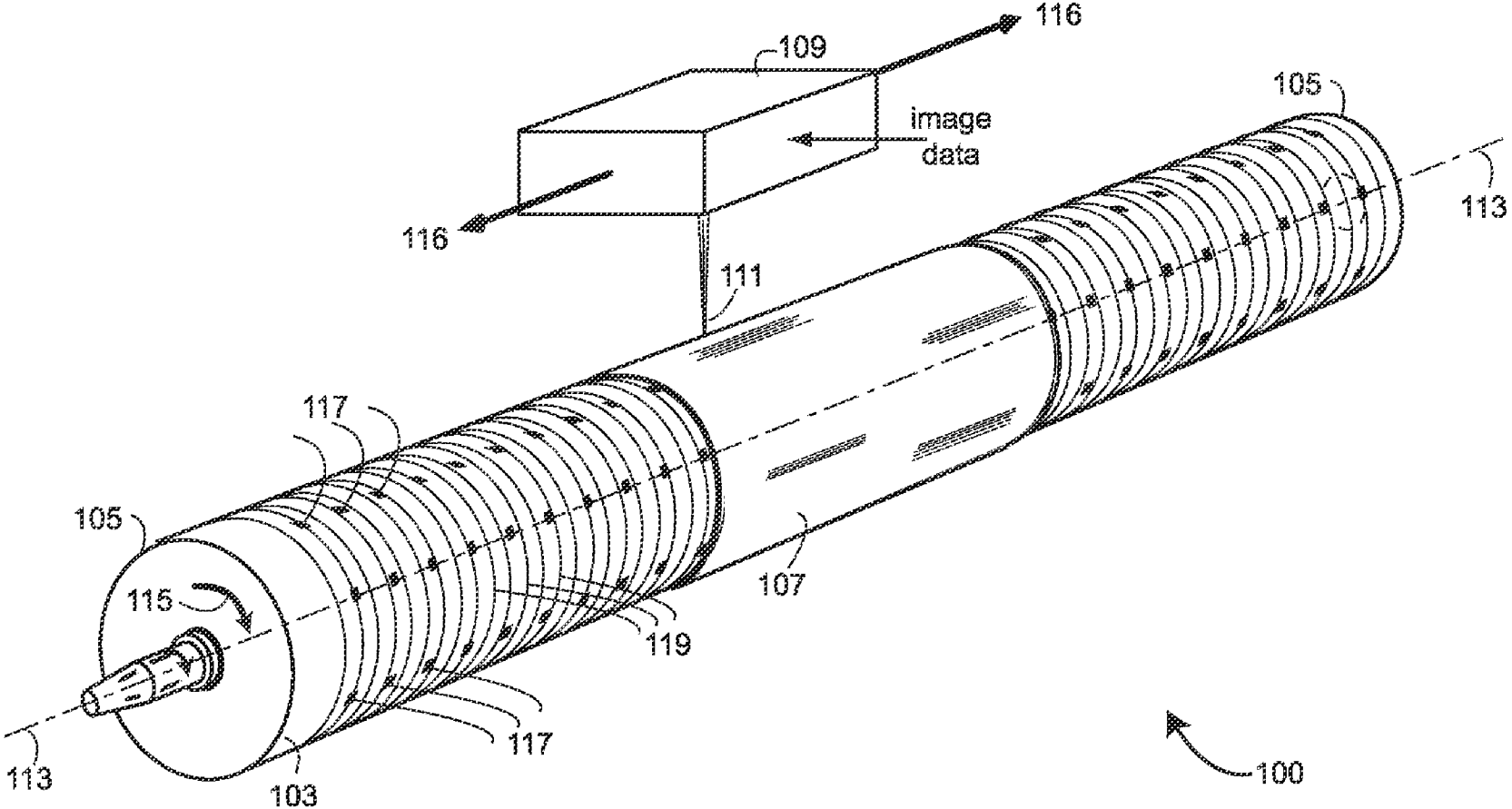
FIG. 1A (Prior Art)
FIG. 1A shows in simplified form a perspective view of one embodiment of an external drum imager.

FIG. 1A shows in simplified form a perspective view of one embodiment of an external drum imager 100, e.g., a computer-to-plate exposing imager that can include an embodiment of the present invention. The imager 100 includes a substantially cylindrically shaped drum 105 that is rotatable about an axis 113. The drum has a support surface on which a plate is placeable. The drum 105 and its support surface 103 is shown with a plate 107 wrapped around the drum's support surface 103. The imager 100 includes a laser and optical system, shown in simplified form as 109, generating a laser beam 111 that is modulated by image data provided by a computer (not shown). Many of the elements of the imager are not included in order to simplify illustrating the imager 100. As the drum 105 is rapidly rotated with the plate 107 on the surface 103 of the drum sleeve 105, the laser beam moves in a transverse (fast scan) direction 115 relative to the drum surface and this generates one or more exposed circumferential lines in the transverse direction perpendicular to the direction of the axis 113 of rotation. At the same time in one embodiment, the laser beam moves in the longitudinal (slow-scan) direction 116 parallel to the axis of rotation 113. Such exposing is commonly known for external drum scanners.

In one embodiment, the drum 105 includes a set of vacuum grooves 119, with in one version, each groove forming a circular track around the circumference of outer surface of the drum 105. Other versions have the vacuum grooves arranged differently, and in all versions, the vacuum grooves, if present, are arranged to help maintain a plate on the outer surface by applying suction to the grooves.

In another embodiment, vacuum holes rather than grooves are used. In yet another embodiment, a combination of grooves and holes is used.

In one embodiment, the drum includes permanent magnets 117 embedded into the drum surface in order to help maintain a metal-backed plate on the outer surface.

Figure 1B:
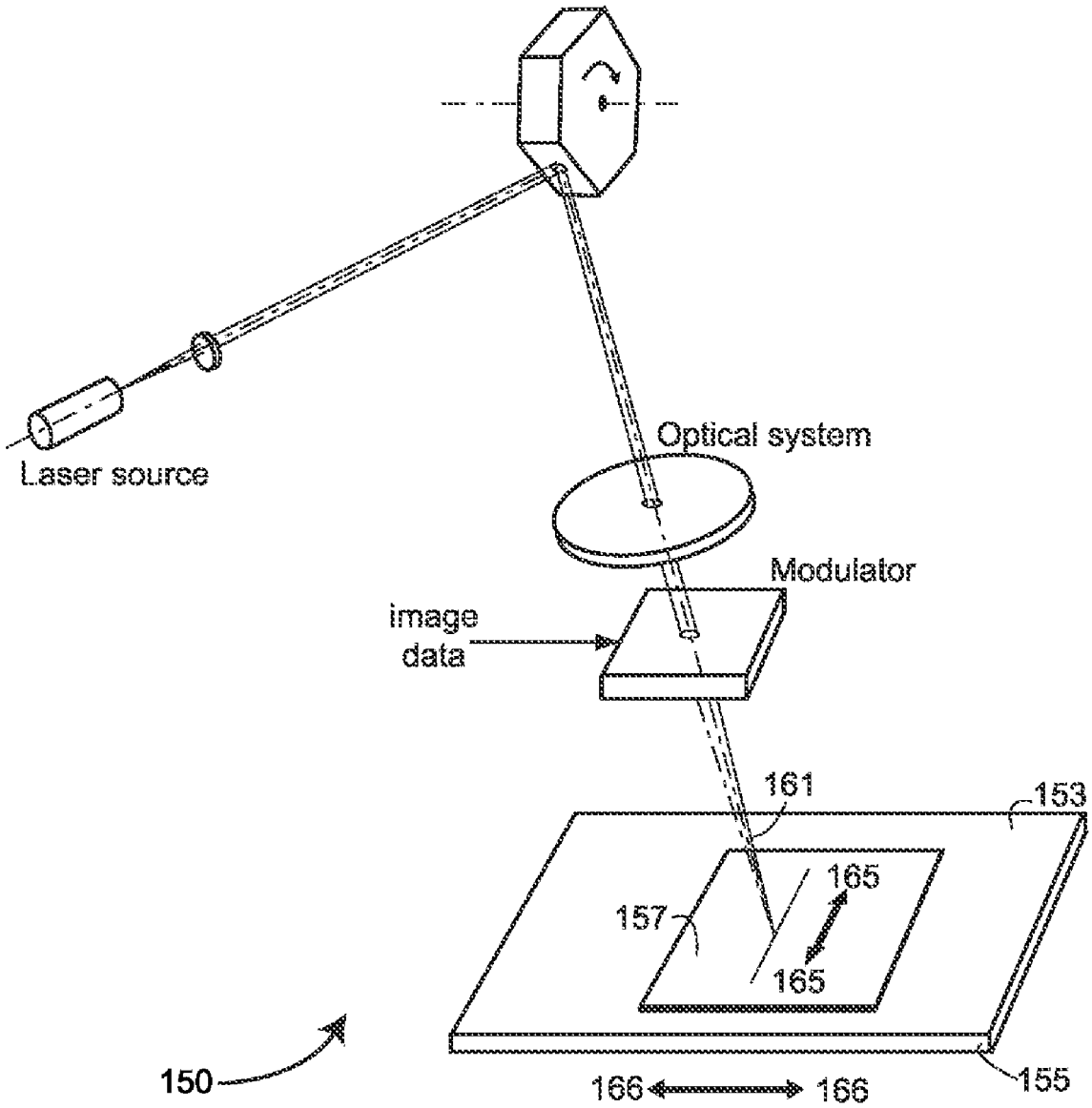
FIG. 1B (Prior Art)
FIG. 1B shows in simplified form a perspective view of one embodiment of a flatbed imager.

FIG. 1B shows in simplified form a perspective view of an alternate embodiment of an imager, this imager 150, e.g., a computer-to-plate exposing imager being a flatbed imager 150 that can include an embodiment of the present invention. The imager 150 includes a support structure 155 having a substantially flat support surface 153 on which a plate is placeable, such a structure 155 shown with a plate 157 on the surface 153. The imager 150 includes a laser and optical system in combination with a modulation system generating a laser beam 161 that is modulated by image data provided by a computer (not shown). As in FIG. 1A, many of the elements of the imager are not included in order to simplify illustrating the imager 150. A mechanism, either in the form of a rotating polygon, or a holographic system is used to case the laser beam to generate exposed lines in the transverse direction 165 substantially perpendicular to a longitudinal direction 166. The plate and beam are slowly moved relative to each other in the longitudinal direction 166. Such exposing is commonly known for flatbed scanners. The support surface 153 may also include a set of vacuum grooves and/or vacuum holes (not shown) arranged to help maintain a plate on the surface by applying suction to the grooves, and may further have a set of permanent magnets (not shown).

The remainder of the description will be mostly for the drum scanner, e.g., as shown in FIG. 1A, and those in the art will understand how to modify the description for the flatbed configuration of FIG. 1B. Internal drum imagers also are known, and an embodiment of the invention also may be applicable to such an imager.

Figure 2:
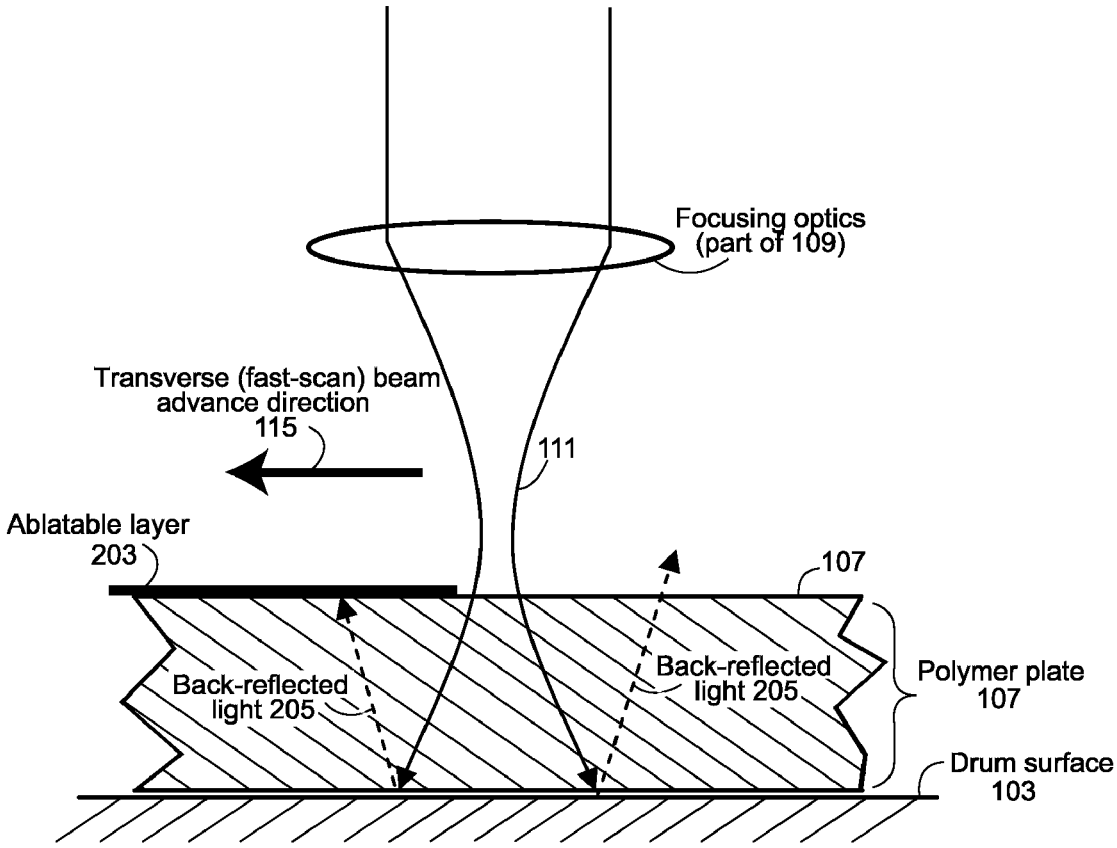
FIG. 2 (Prior Art)
FIG. 2 shows in simplified and enlarged form a cross-section near the support surface of an imaging drum or flatbed scanner.

FIG. 2 shows in simplified and enlarged form a cross-section near the support surface of an imaging drum or flatbed scanner. Suppose this is the surface 103 of the drum 105 of the drum scanner of FIG. 1A near the edge of the plate. Note that for simplicity, no curvature is shown. The plate 107 is assumed to be a polymer plate with a layer 203 of ablatable material. The plate is shown on the support surface 103 of the drum. The laser beam 111 is shown moving on the transverse (fast) direction 115 as a result of rotation of the drum. After traversing the cross-section of the plate, some of the beam 111 is back-reflected to back-reflected beams 205 from the surface 103, and as shown, some of this may expose the back of the ablatable material 203. It is desired to reduce or eliminate the back-reflected light 205 that can hit the back of the ablatable material 203.

Figure 5:
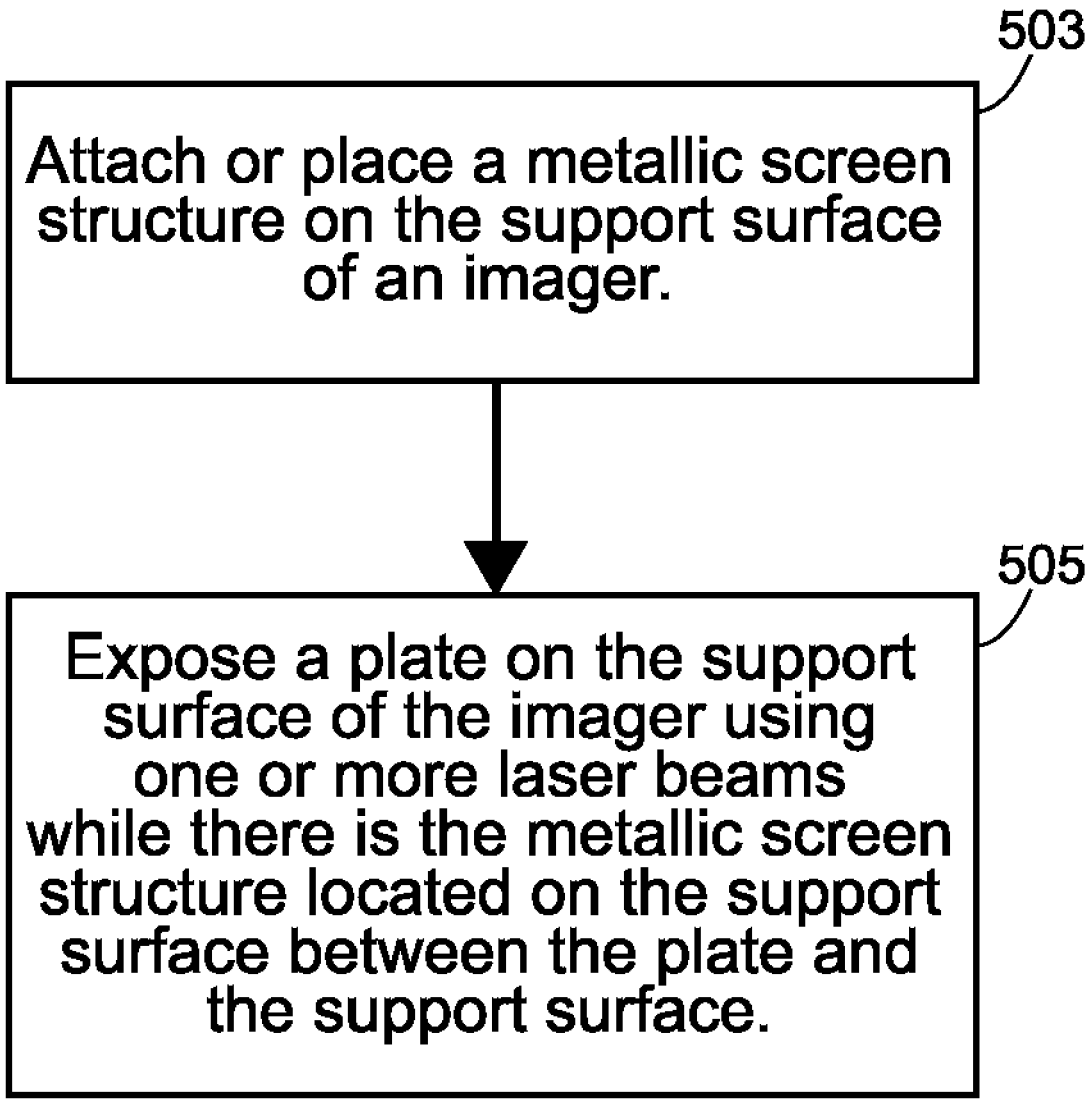
FIG. 5 shows a simplified flowchart of a method embodiment of the present invention.

One embodiment of the invention is shown in the flowchart of FIG. 5 and includes in 503 attaching or placing a metallic screen structure on the support surface of the imager; and in 505 exposing a plate on the support surface of the imager using one or more laser beams while there is the metallic screen structure located on the support surface between the plate and the support surface, such that the amount of back-reflected radiation is reduced compared to the plate being placed directly on the support structure with no screen between the plate and support surface.

Figure 3A:
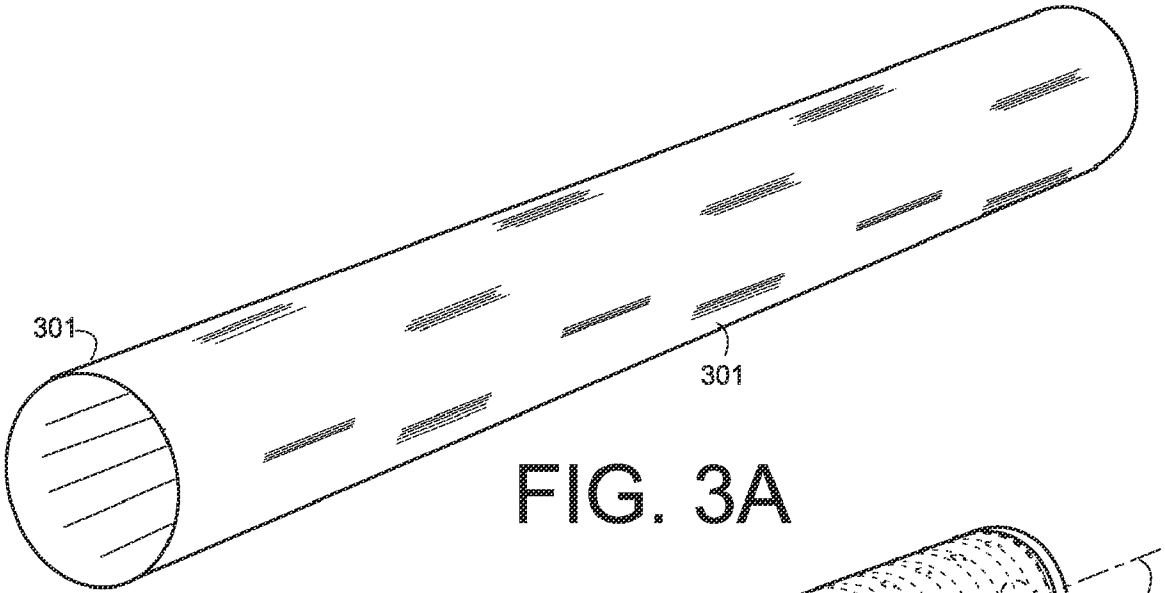
FIG. 3A shows a substantially cylindrically shaped sleeve 301 made of a metal screen material according to an embodiment of the present invention.
Figure 3B:
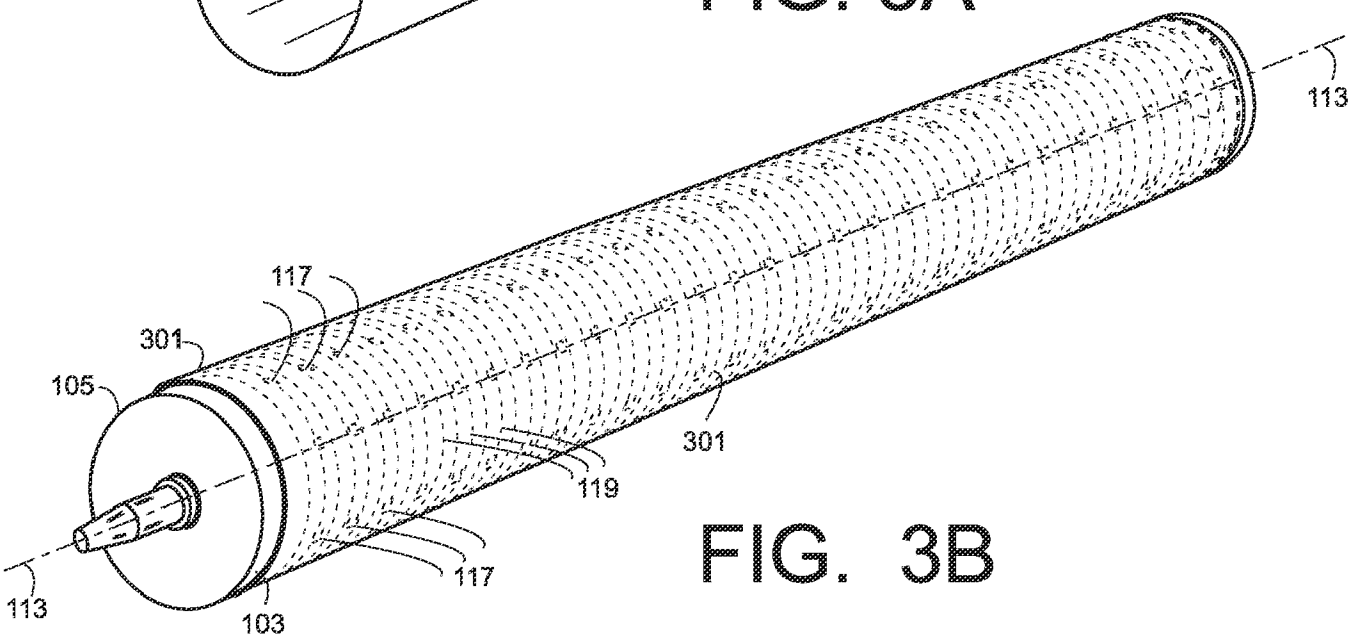
FIG. 3B shows the support surface of a drum with the sleeve of FIG. 3A on the support surface.

The screen structure is made of a metallic material that is relatively resistant to laser radiation in the range energy densities that would occur at the rear side of a plate during the imaging if no metallic screen structure was located on the support surface Another embodiment of the invention includes the support surface of the imager and a metal screen in sheet form that is modified to be on the support surface 103 of the imager, e.g., surface 103 of drum 105. FIG. 3A shows a substantially cylindrically shaped sleeve 301 made of a metal screen material and configured to fit over the imaging drum, e.g., drum 105 on the support surface 103. FIG. 3B shows the support surface 103 of drum 105 with the embodiment of the sleeve 301 of screen material on the surface 103.

The screen material is also configured to be relatively permeable to air so that covering vacuum groves or holes such as grooves 119 does not substantially reduce the attractive forces of the vacuum to the plate.

Experiments were performed using a sleeve 301 made from off-the shelf metal screen originally designed for another purpose—for rotary screen textile printing. Manufacturers of such screen material include Stork Prints B.V. of Boxmeer, the Netherlands, Saxon Screens Rotationsschablonen GmbH of Frankenberg, Germany; Saueressig GmbH+Co. of Vreden, Germany, and Rothtec Engraving Corporation, New Bedford, Mass., USA. Such screens are typically made of nickel or a nickel alloy that the inventors have found is sufficiently resistant to laser radiation in moderate energy densities as would typically occur at the rear side of a polymer plate or film during exposure as a result of back-reflected radiation. Such screens have been found by the inventors to easily be attracted by the magnetic forces of a drum equipped with magnets such as magnets 117. Furthermore, the inventors found that such screen material is very permeable to air. For example, in some embodiments, the screen material has rhombic structures, and in other embodiments, honeycomb-like grid structures. The relative permeability to air makes it possible to cover vacuum groves or holes such as grooves 119 without substantially reducing the attractive forces of the vacuum to the plate.

One embodiment the screen structure includes a woven metallic fabric. In another embodiment, the screen structure is made using a galvanic process.

While off-the shelf screens manufactured for other purposes are usable, the inventors found that there are some properties that are even more desirable to reduce unwanted ablation by back-reflected laser radiation.

One property is that the holes are not too wide so that the screen sufficiently reduces the back-reflected laser light during exposure. The inventors carried out initial tests with 60 holes per inch and 125 holes per inch and these worked well. Mesh of up to 200 holes per inch work sufficiently well. Typically, a screen with between 110 and 140 holes per inch is used.

Another property is relative permeability to air. The inventors have found that screens with a relative open area of approximately 25 to approximately 50% of the overall area are suitable, at a mesh range of between 60 and 200 holes per inch work sufficiently well.

Figure 4A:
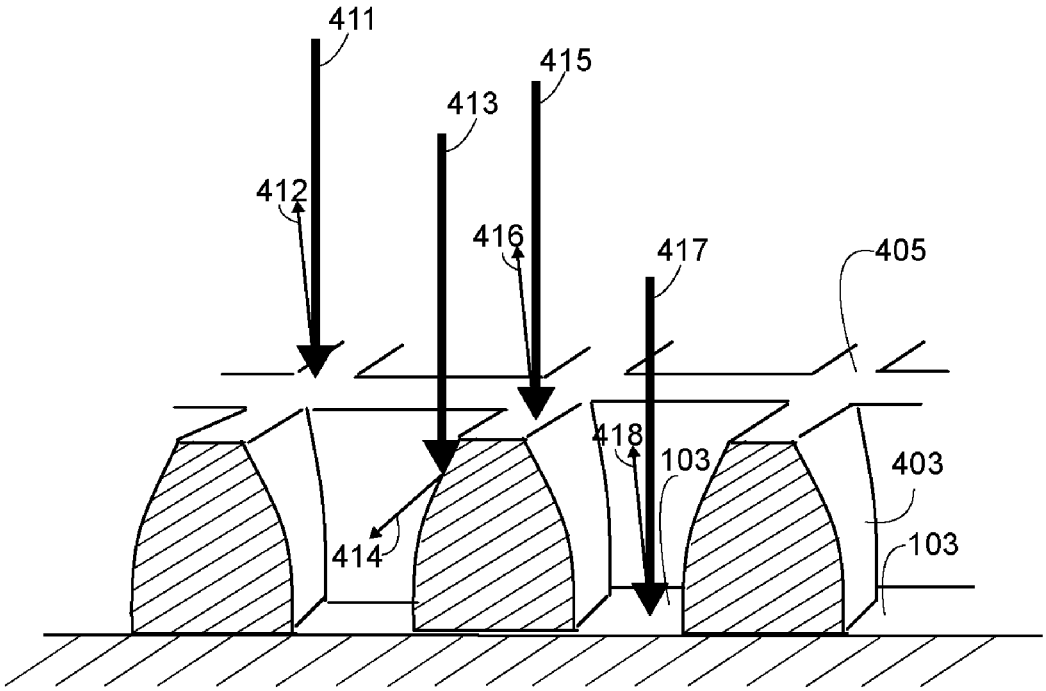
FIG. 4A shows a perspective view including a cross-section through the grid of a rotary screen on a support surface according to one embodiment of the present invention.

Another property is relative roughness in order to reduce backscatter from the screen itself. The undesired effects of backscatter are based mainly on reflection. FIG. 4A shows a perspective view including a cross-section through the grid of one rotary screen 403 on the support surface 103. The top surface 405 of the screen has a relatively large area parallel to the plate surface. FIG. 4A shows four example incident beams 411, 413, 415, and 417, and each incident beam's respective resulting reflected beam 412, 414, 416, and 418, respectively. As can be seen, because of the top surface 405 having a significant area parallel to the plate, the reflected beams 412, 416, and 418 are reflected straight back (shown almost parallel to the respective incident beam but at a slight angle in FIG. 4A for illustrative purpose) either from the top surface 405 or the drum surface 103. Such a screen allows a significant amount of light to be reflected back to the plate surface.

Figure 4B:
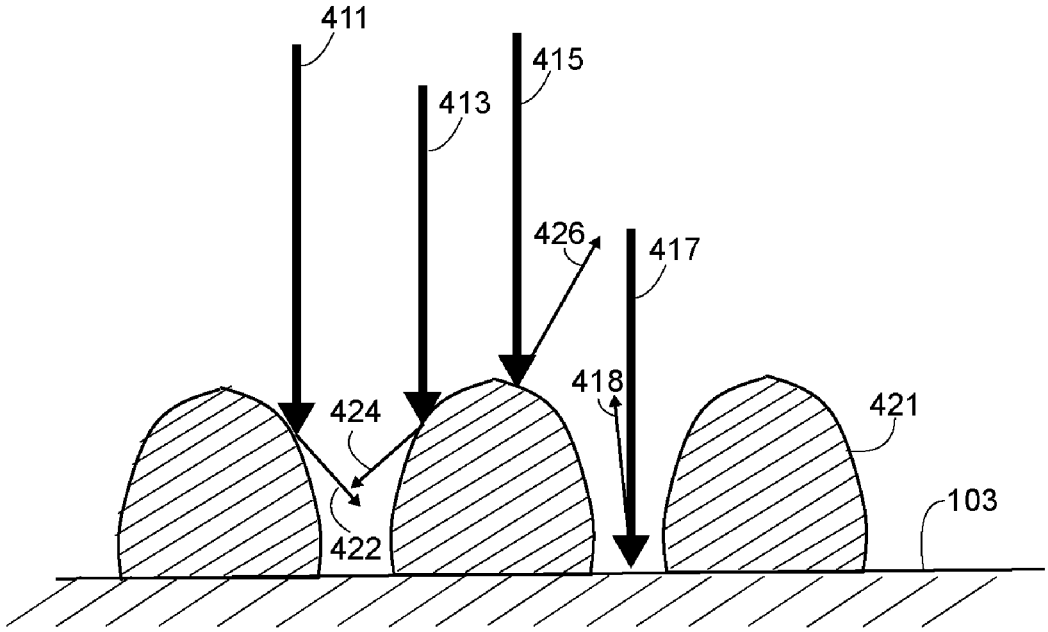
FIG. 4B shows a cross-section through the grid of a rotary screen on a support surface according to another embodiment of the present invention.

FIG. 4B shows a cross section of an improved screen 421. The shape of the screen 421 is slightly modified from that of the screen 403 of FIG. 4A in a way that the main part of oncoming light is more or less scattered in various directions. In particular, the sides of walls of holes are relatively curved, e.g., more than the case of FIG. 4A in order to direct more of the incoming radiation into different directions. The flat part on top of the grid is also curved for the same reason and small compared to the structure of FIG. 4A. That is, the screen structure has a structure closest to the back of the plate and parallel to the support surface that is relatively small. These properties result in a reduction of the direct back-reflection of the laser radiation propagating towards the surface of the drum. More of the radiation is reflected in a diffuse manner instead of being reflected in the direction of origin as is the case with the screen of FIG. 4A. Furthermore, the opening between the bars has become smaller reducing the area of the drum surface which can directly reflect the incoming light, even though the % of the screen is the same. Consider again the four example incident beams 411, 413, 415, and 417, and each incident beam's respective resulting reflected beam 422, 424, 426, and 418, respectively. Reflected beams 422 and 426 are now less likely to cause a problem than the corresponding reflected beams 412 and 416 of FIG. 4A. Reflected beam 418 could be problematic in both cases, being through the opening and from the support surface 103, and reflected beams 414 and 424 are not likely to cause back-reflection problems in both cases.

As can be seen, because of the top surface 405 having a significant area parallel to the plate, the reflected beams 412, 416, and 418 are reflected straight back (shown almost parallel to the respective incident beam but at a slight angle in FIG. 4A for illustrative purpose).

Such a structure as shown in FIG. 4B can be easily obtained from a structure such as shown in FIG. 4A by using a galvanic manufacturing process as is commonly used for nickel screen sleeves for textile printing.

One embodiment uses a 125 holed per inch screen made by a galvanic process to have relatively curved sides and relatively little flat area on the top surface.

Those in the art will be familiar with many galvanic processes. One such process includes:

1. A copper cylinder being covered with an opaque material, e.g., a black ink-like material.
2. In a laser engraving machine, an image of a honeycomb-like structure in the size of the desired mesh being ablated from the cylinder.
3. In a galvanic solvent, nickel is accumulated to the areas on the copper cylinder revealed by the engraving process.
4. After the nickel screen which now has been built around the copper cylinder has reached a required thickness, the nickel screen is expanded by hot water and thus removed from the copper cylinder to result in a nickel sleeve.

In one embodiment, the surface of the screen has a relatively rough surface rather than a relatively smooth surface. One embodiment includes etching the screen to result in a screen with a fine etched surface.

While one embodiment uses a screen made from nickel, alternate embodiments may be made from any kind of metal and metal alloy that can be arranged in a screen or fabric structure. Different embodiments use one or more of nickel, iron, steel, brass, aluminum, copper, silver, gold, and/or platinum.

While one embodiment includes exposing a plate on a rotating drum imager which has a screen structure thereon, another embodiment includes exposing a plate on a flatbed imager.

While the discussion above mentions screens that are likely to have a regular structure, alternate embodiments use screens that do not have a regular structure. Similarly, the relative transparency of the screen need not be uniform, and so forth. Many variations are possible.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Description of Example Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

All publications, patents, and patent applications cited herein are hereby incorporated by reference.

Any discussion of prior art in this specification should in no way be considered an admission that such prior art is widely known, is publicly known, or forms part of the general knowledge in the field.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

We claim:

1. A method comprising:

exposing a plate on a support surface of an imager using one or more laser beams, the exposing while there is a permeable metallic screen structure having between 60 and 200 through holes per inch and located on the support surface between the plate and the support surface, wherein the screen structure's through holes are permeable to the laser radiation of the laser beams and allow air to pass though the screen structure, the through holes having side walls in the dimension perpendicular to the support surface that are relatively curved walls in the sides of holes, such that when the screen structure is placed on the support surface, the open area of the holes varies with distance from the support surface, such that the amount of back-reflected radiation is reduced compared to the plate being placed directly on the support surface with no screen structure between the plate and support surface, and such that a pattern not reproduced on the plate material by back-reflected radiation, wherein the screen structure is made of a material that is relatively resistant to laser radiation in the range energy densities that would occur at the rear side of a plate during the imaging if no screen structure was located on the support surface.

2. A method as recited in claim 1, wherein the imager is a drum imager including a drum, and wherein the support surface is the surface of the drum.

3. A method as recited in claim 1, wherein the imager is a flatbed imager and the support surface is the relatively flat surface of the flatbed imager.

4. A method according to claim 1, wherein the plate includes an ablatable layer.

5. A method according to claim 1, wherein the plate includes a film plate.

6. A method according to claim 1, wherein the plate includes a photopolymer plate.

7. A method according to claim 1, wherein the plate is metal-backed plate, wherein the support surface has one or more magnetic structures configured to help keep the metal-back plate on the surface, and wherein the metallic screen structure includes a magnetizable material such that the plate is maintainable on the combination of the support surface and the metallic screen structure thereon.

8. A method according to claim 1, wherein the metallic screen structure is attached to the support surface.

9. A method according to claim 1, wherein the support surface has one or more vacuum grooves and/or holes to which a vacuum is applicable, and wherein the screen structure has sufficient relative permeability to air, such that when a vacuum is applied to the vacuum grooves and/or holes, the plate is maintainable on the combination of the support surface and the metallic screen structure thereon.

10. A method according to claim 1, wherein the screen structure includes nickel or a nickel alloy.

11. A method according to claim 10, wherein the screen structure has a structure of between 110 and 140 through holes per inch.

12. A method according to claim 1, wherein the screen structure has a structure with a relative open area of approximately 25 to approximately 50% of the overall area.

13. A method according to claim 1, wherein the screen structure has less material on the side of the screen structure closest to the back of the plate and parallel to the support surface than on the side of the screen structure that is closest to the support surface.

14. A method according to claim 1, wherein the screen structure is made by a galvanic process to have a relatively small amount of material on the screen structure side closest to that plate than on the screen structure side closest to the support surface.

15. A method according to claim 1, wherein the screen structure includes one or more of nickel, iron, steel, brass, aluminum, copper, silver, gold, and/or platinum.

16. A method according to claim 1, wherein the screen structure includes a woven metallic fabric.

17. An apparatus comprising:

a base structure including a support surface of an imager that uses one or more laser beams to expose a plate, the support surface configured to support a plate thereon; and a permeable metallic screen structure located on the support surface between a plate and the support surface, the plate placed on the screen structure, the metallic screen structure made of a material that is relatively resistant to laser radiation in the range energy densities that would occur at the rear side of a plate during the imaging if no screen structure was located on the support surface, the screen structure having between 60 and 200 through holes per inch that are permeable to the radiation from the laser beams and that allow air to pass though the screen structure, the through holes having side walls in the dimension perpendicular to the support surface that are relatively curved walls in the sides of holes, such that when the screen structure is placed on the support surface, the open area of the holes varies with distance from the support surface such that during imaging of the plate using the imager, the amount of back-reflected radiation is reduced compared to the plate being imaged when being placed directly on the support surface with no screen structure between the plate and support surface, and such that a pattern is not produced on the plate material by back-reflected radiation.

18. An apparatus as recited in claim 17, wherein the imager is a drum imager including a drum, and wherein the support surface is the surface of the drum.

19. An apparatus as recited in claim 17, wherein the imager is a flatbed imager and the support surface is the relatively flat surface of the flatbed imager.

20. An apparatus as recited in claim 17, wherein the plate is metal-backed plate, and wherein the support surface has one or more magnetic structures configured to help keep the metal-back plate on the surface, and wherein the metallic screen structure includes a magnetizable material such that the plate is maintainable on the combination of the support surface and the metallic screen structure thereon.

21. An apparatus as recited in claim 17, wherein the support surface has one or more vacuum grooves and/or holes to which a vacuum is applicable, and wherein the screen structure has sufficient relative permeability to air, such that when a vacuum is applied to the vacuum grooves and/or holes, the plate is maintainable on the combination of the support surface and the metallic screen structure thereon.

22. An apparatus as recited in claim 17, wherein the screen structure has less material on the side of the screen structure closest to the back of the plate and parallel to the support surface than on the side of the screen structure that is closest to the supporting surface.

23. An apparatus as recited in claim 17, wherein the screen structure is attached to the support surface.

24. An apparatus as recited in claim 17, wherein the screen structure has a structure of between 110 and 140 through holes per inch.

25. An apparatus as recited in claim 17, wherein the screen structure has a structure with a relative open area of approximately 25 to approximately 50% of the overall area.

26. An apparatus as recited in claim 17, wherein the screen structure includes one or more of nickel, iron, steel, brass, aluminum, copper, silver, gold, and/or platinum.

* * * * *